US005386906A

United States Patent [19]

Lai

[11] Patent Number: 5,386,906

[45] Date of Patent: Feb. 7, 1995

[54] BALL HOLDER

[76] Inventor: Shih-nan Lai, 11F, No. 67, Sec. 1, Ho-ping East Road, Taipei, Taiwan, Prov. of China

[21] Appl. No.: 229,306

[22] Filed: Apr. 18, 1994

[51] Int. Cl.[6] ..... A63B 47/00

[52] U.S. Cl. ..... 206/315.9; 224/919

[58] Field of Search ..... 273/320; 224/919; 206/315.9, 315.91; 294/137, 146, 165

[56] References Cited

U.S. PATENT DOCUMENTS

| | | | |
|---|---|---|---|
| 3,865,290 | 2/1975 | Sperling | 224/919 X |
| 4,269,338 | 5/1981 | Sichel | 224/919 X |
| 4,305,584 | 12/1981 | Lecham | 224/919 X |
| 4,510,982 | 4/1985 | Sangroni | 206/315.9 |
| 4,691,824 | 9/1987 | Schindler | 206/315.9 |
| 4,993,548 | 2/1991 | Peterson | 224/919 X |
| 5,085,320 | 2/1992 | Scott | 206/315.9 |
| 5,238,162 | 8/1993 | La Civita | 206/315.9 X |

FOREIGN PATENT DOCUMENTS

| | | | |
|---|---|---|---|
| 2310780 | 12/1976 | France | 224/919 |

*Primary Examiner*—William E. Stoll

*Attorney, Agent, or Firm*—Bacon & Thomas

[57] ABSTRACT

A ball holder comprises a first and a second holding member detachably connected by a string threaded through holes formed on the holding members via a predetermined route. An M-shaped fastening member and a fastening plate are provided on the first holding member for adjusting the looseness of the string and thereby permitting a ball to be fitly and firmly clamped between the first and the second holding members. A portion of the string between the fastening member and two fixing holes formed on the second holding member serves as a carrying means, and a support is attached to one side of the first holding member to hold an inflator for convenient use.

1 Claim, 6 Drawing Sheets

PRIOR ART

PRIOR ART

BALL HOLDER

BACKGROUND OF THE INVENTION

The present invention relates to a ball holder which mainly comprises a first holding member, a second holding member, a string, and a fastening plate. The string is threaded through a plurality of grooves and through holes provided on the two holding members to detachably bind the same together for a ball to be fitly clamped between them. A small inflator can be supported on a side cradle attached to the ball holder for convenient inflation of ball.

There are two types of conventional ball holder which are most frequently utilized. One of which is a netted bag as shown in FIG. 1. While balls 6 held by such netted bag can be conveniently carried, they can not be stably stacked when they are not in use and therefore, occupy considerably large space for storage. Moreover, the netted bag is provided at its top with only one tiny string for carrying purpose which tends to hurt the user's finger or shoulder when the netted bag is supported thereon. The other type of ball holder is shown in FIG. 2 and mainly consists of two lampshade-like covers, i.e., an upper cover 4 and a lower cover 5. A tenon 41 and a mortise 51 are correspondingly formed on a head portion of the upper cover 4 and the lower cover 5, respectively, to enable the vertical stacking of each ball holder over the other, as shown in FIG. 3. The shortcomings existed in this type of ball holder are as follows:

1. No carrying means is provided and therefore, the ball holder must be carried with two hands or another bag.
2. The upper and the lower covers 4 and 5 are easily separated from each other and let the ball 6 fall out of the ball holder.
3. The upper and the lower covers 4 and 5 are so designed that they can not be fitted to hold balls of different types and/or dimensions, such as basketball, volley ball, Rugby football, etc.
4. Inflator for ball inflation must be separately carried by a bag or the like which is inconvenient for the user.

It is therefore desirable to develop an improved and more practical ball holder to eliminate the shortcomings existed in the conventional types of ball holder.

SUMMARY OF THE INVENTION

A primary object of the present invention is to provide a ball holder which can be conveniently used to fitly hold balls of any size.

Another object of the present invention is to provide a ball holder which can be stably stacked over one another for storage with minimum space.

A further object of the present invention is to provide a ball holder which has simple structure and can be quickly and easily operated for use.

A still further object of the present invention is to provide a ball holder which is provided with means to conveniently hold an inflator therewith.

The ball holder according to the present invention mainly comprises a first holding member and a second holding member. Both the first and the second holding members are annular rings having a first end with smaller diameter than that of a second end thereof and therefore forming a circle of inclined side wall with a certain predetermined height and thickness. Curved grooves are formed on an end surface of the first end of both the first and the second holding members, and through holes are formed on the side walls of the first and the second holding members for a string to thread through, enabling the first and the second holding members to fitly hold a ball of any shape and size therebetween. To firmly pull the two holding members toward each other by the string, a substantially M-shaped fastening means and a fastening plate are used to support the string for the same to pass them and be firmly fixed thereto, facilitating the formation of a shoulder strap on the ball holder for convenient carrying. And a sideward extended cradle is provided at one side of the first holding member for holding an inflator.

BRIEF DESCRIPTION OF THE DRAWINGS

The features, other objects and advantages of the present invention can be best understood by referring to the following detailed description of the preferred embodiment and the accompanyings wherein.

DETAILED DESCRIPTION OF THE PREFERRED EMBODIMENT

Figure 4:
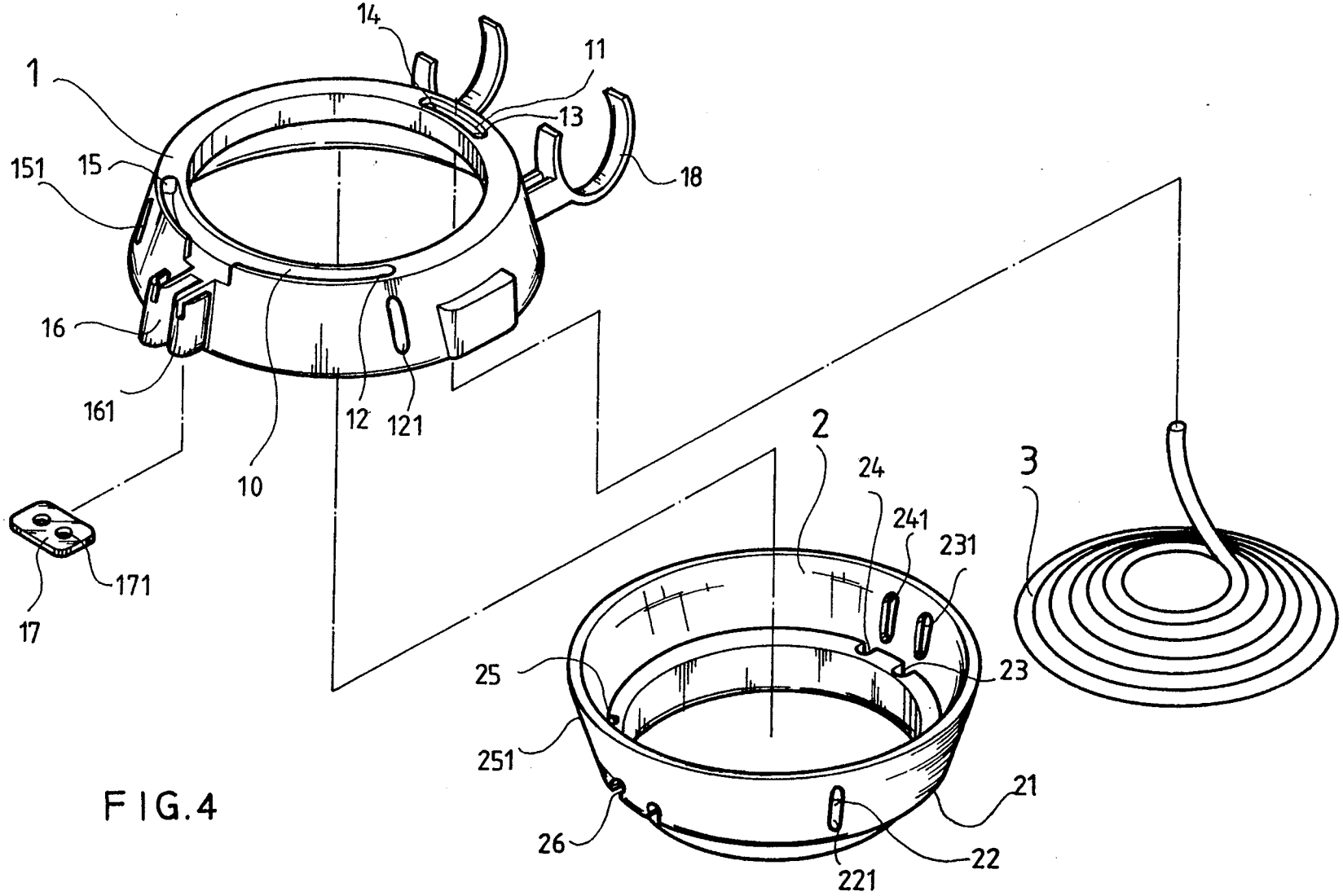
FIG. 4 is a disassembled perspective view of the ball holder according to the present invention.

Please refer to FIG. 4. The present invention relates to a ball holder which comprises a first holding member 1, a second holding member 2, a string 3, and a fastening plate 17 with two though holes 171. Both of the first and the second holding members 1 and 2 are an annular ring having a first end with smaller diameter than that of a second end thereof and therefore forming a circle of inclined side wall with a certain predetermined height and thickness. A long curved groove 10 is formed on an end surface of the first end of the first holding member 1, and a short curved groove 11 is further formed on the end surface of the first end of the first holding member 1 opposite to the long curved groove 10. Through holes 12, 15 and 13, 14 are formed at two ends of the long and the short curved grooves 10, 11, respectively. Substantially axially extended elongated holes 121, 151 and 131, 141 (not shown) are provided on the inclined side wall of the first holding member 1 at positions corresponding to the through holes 12, 15 and 13, 14, respectively. A fastening means 16 having a substantially M-shaped cross section is provided on the side wall of the first holding member 1 corresponding to a central portion of the long curved groove 10 with its two openings facing toward the first holding member 1, such that the long curved groove 10 is communicable with the two openings of the M-shaped fastening means 16. The M-shaped fastening means 16 has two dents 161 separately formed on an outward point of the fastening means 16.

The second holding member 2 has an radially inward flange 21 formed near its first end. Through holes 22, 25 and 23, 24 are formed on a top surface of the inward flange 21 at positions corresponding to the through holes 12, 15 and 13, 14 of the first holding member 1, respectively; and axially extended elongated holes 221, 251 and 231, 241 are provided on the side wall of the second holding member 2 at positions corresponding to the through holes 22, 25 and 23, 24, respectively. Two fixing holes 26 are further formed on the side wall of the second holding member 2 abutting on the top surface of the inward flange 21 at positions corresponding to the two openings of the M-shaped fastening means 16.

Figure 5:
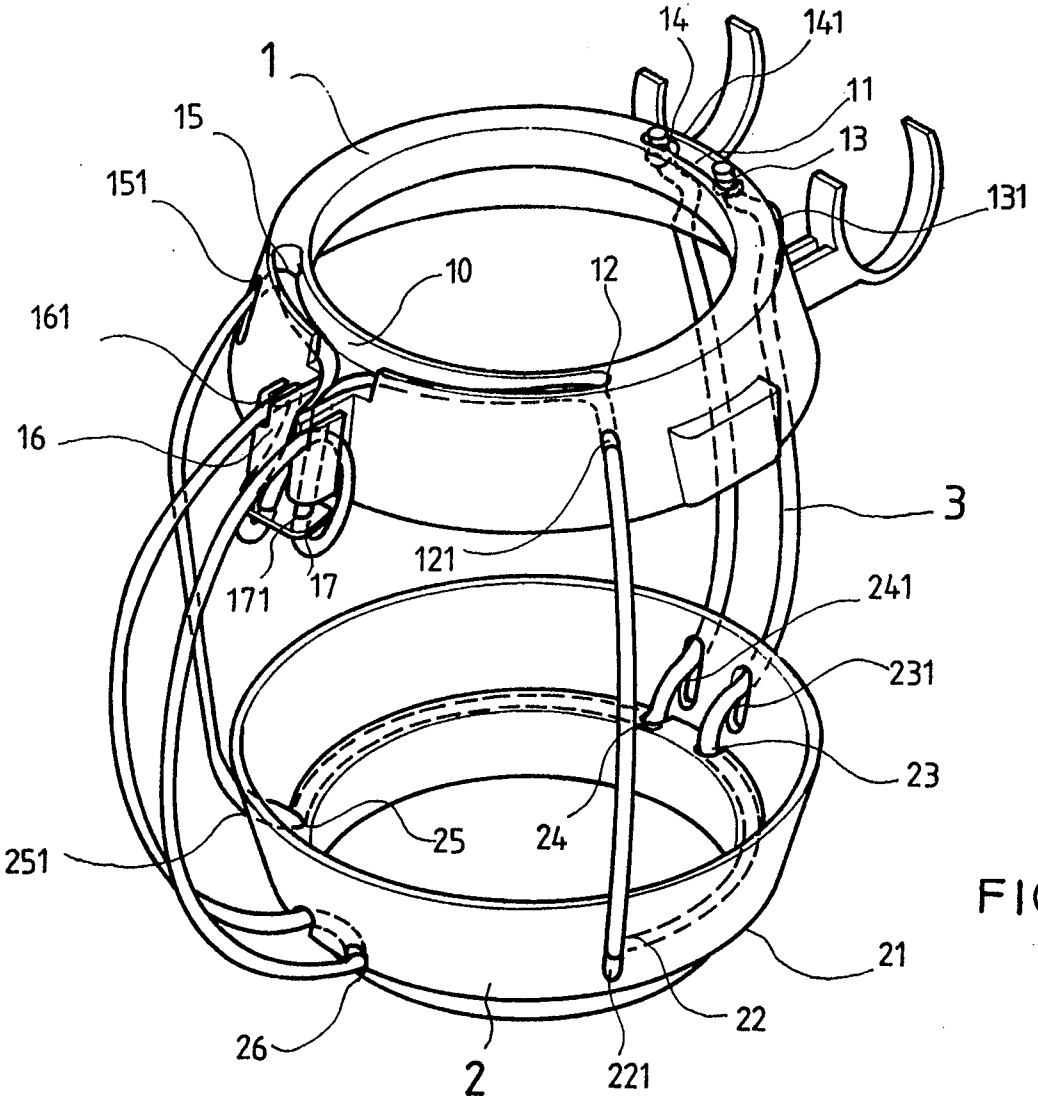
FIG. 5 is an assembled perspective view of the ball holder according to the present invention.

Please refer to FIG. 5 which illustrates the route of the string 3. The string 3 is first tied at one end to form a knot, and is then threaded with the other free end thereof to sequentially pass through the hole 13, the elongated hole 131, the elongated hole 231 of the second holding member 2, by way of the outer surface of the side walls of the first and the second holding members 1 and 2; the string 3 is then directed downward to pass through the hole 23 on the inward flange 21, and pass by a bottom periphery of the inward flange 21 to the through hole 22, the elongated hole 221; the string 3 is further upward threaded through the elongated hole 121 on the side wall of the first holding member 1 and the through hole 12, and then extends along the long curved groove 10 to one of the openings of the M-shaped fastening means 16; the string 3 keeps threading downward through the M-shaped fastening means 16 to one of the through holes 171 of the fastening plate 17 and then turn around to extend upward and through the original opening of the fastening means 16 and passes through a corresponding dent 161 before it is threaded through the first fixing hole 26 from outside of the second holding member 2; the string 3 is then turned around inside the second holding member 2 to get out of the same by way of the second fixing hole 26; thereafter, the string 3 is directed upward to pass through another dent 161 and another opening of the M-shaped fastening means 16 from top to bottom thereof, and then turned upward again to extend along the long curved groove 10 until it reaches the through hole 15; at this point, the string 3 is threaded downward into the through hole 15 and the elongated hole 151 and keeps moving down to the elongated hole 251, through hole 25 on the second holding member 2; the string 3 now moves down along the other side of the bottom periphey of the inward flange 21 until it reaches the through hole 24, the elongated hole 241, and turns upward by way of the outer side of the second and the first holding members 1, 2 to pass through the elongated hole 141 and into the through hole 14; the free end of the string 3 is now tied to form a knot and be retained at one end of the short curved groove 11 while the previously tied knot at the other end of the string 3 is retained at the other end of the short curved groove 11.

When the string 3 is pulled from a portion thereof passing the M-shaped fastening means 16 so that the fastening plate 17 is brought to close contact a bottom end of the fastening means 16, the string 3 is then wound about the fastening means 16 with the string 3 being firmly clamped within two dents 161 of the fastening means 16, thereby, the portion of the string 3 between the dents 161 and the fixing holes 26 may serve as a shoulder strap for convenient carrying of the entire ball holder of the present invention.

Figure 6:
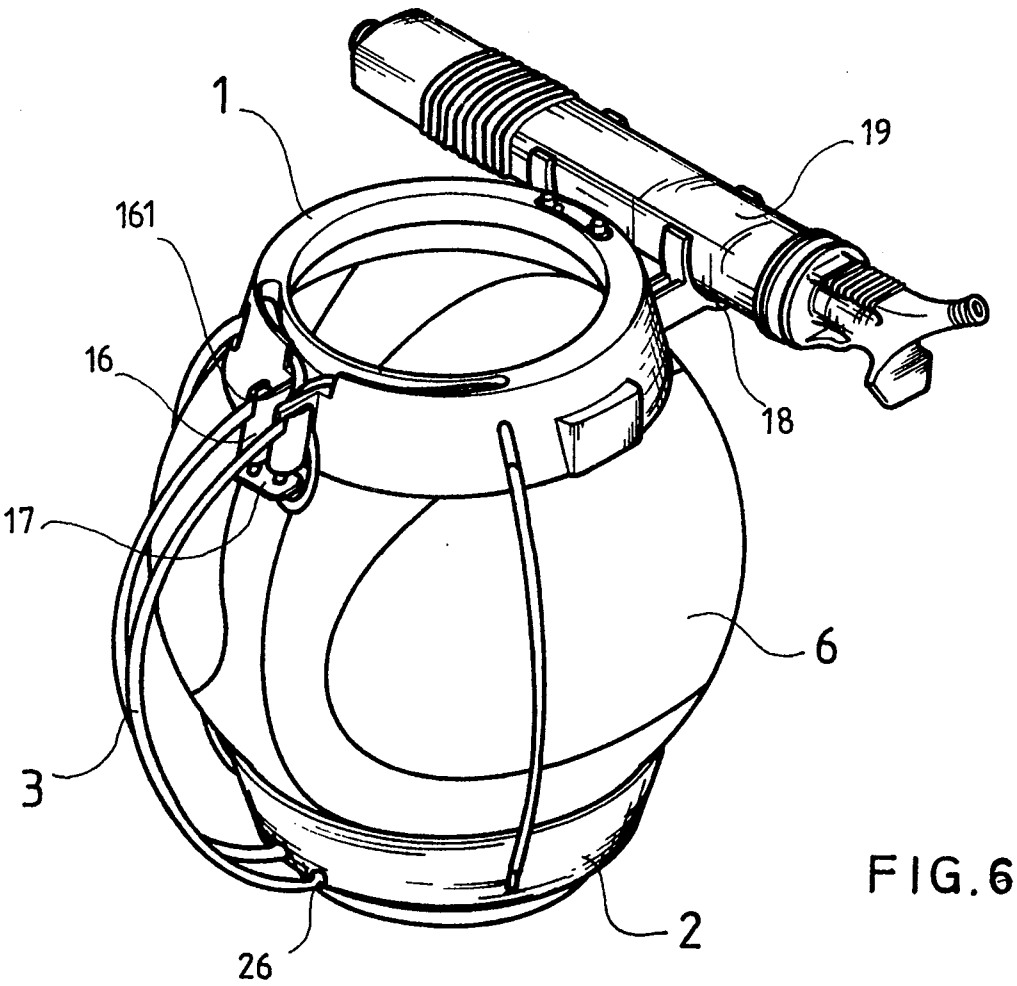
FIG. 6 illustrates a ball and an inflator being held by the ball holder of the present invention.

FIG. 6 illustrates an assembled ball holder of the present invention. A ball 6 is positioned between the the first and the second holding members 1, 2. The string 3 is pulled from the portion near the fastening means 16 so that the first and the second holding members 1, 2 are brought to close to each other and tightly clamp the ball 6 between them. Use the fastening plate 17 as a stopper and positioning means, the string 3 is further pulled and wound about the fastening means 16 until the fastening plate 17 is tightly pressed against the bottom of the fastening means 16. The wound string 3 passes through the dents 161 of the fastening means 16 and is clamped therein, lest it should easily loosen from the fastening means 16.

A laterally extended cradle-like support 18 is provided at one side of the first holding member 1, preferably at a position opposite to the M-shaped fastening means 16, to support an inflator 19 thereon.

To take out the ball 6 clamped between the first and the second holding members 1 and 2, first remove the string 3 from the dents 161 by unwinding the same, allowing the fastening plate 17 to detach from the M-shaped fastening means 16; pull the string 3 at portions other than that locates between the fastening means 16 and the fixing holes 26, allowing the entire string 3 to become loosely between the the first and the second holding members 1, 2; push the first holding member 1 to one side and remove the ball 6 from the two holding members 1, 2.

Figure 1:
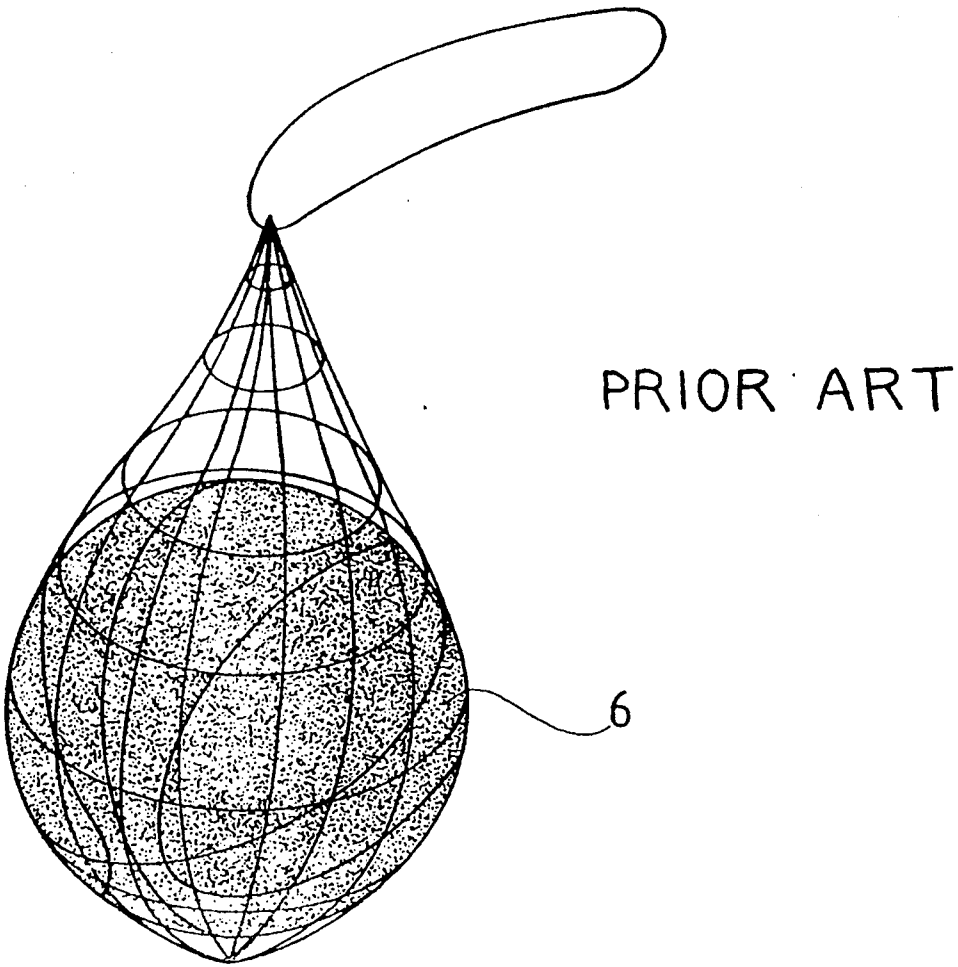
FIG. 1 illustrates a ball held by a conventional ball holder which is substantially a netted bag.
Figure 2:
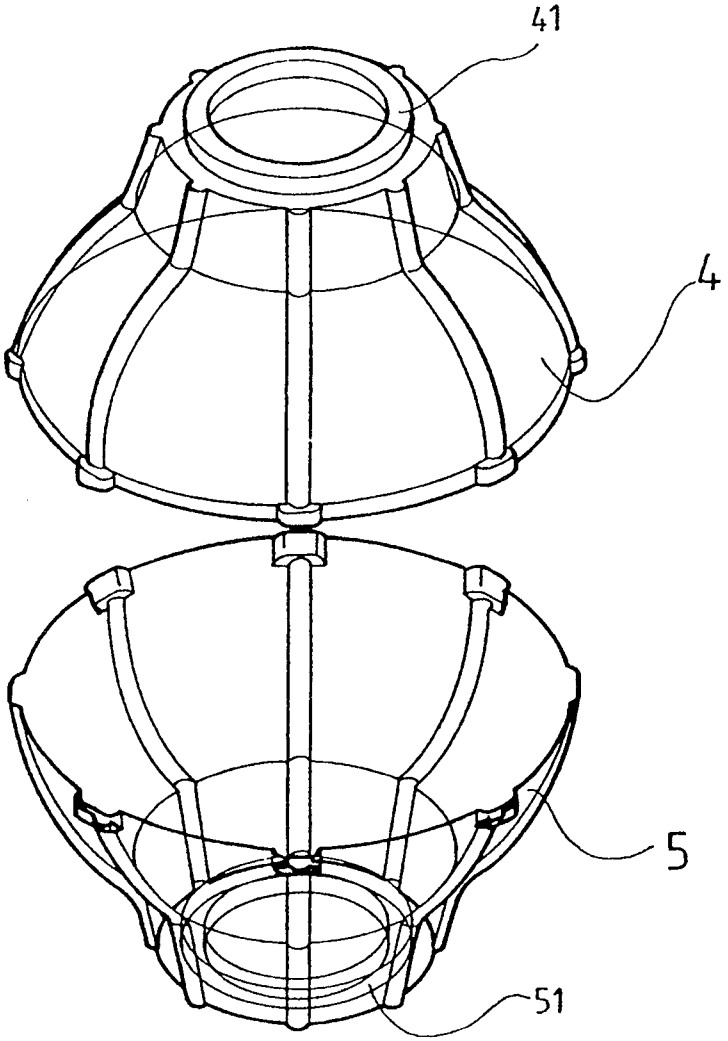
FIG. 2 is a perspective view showing another conventional ball holder consisting of an upper and a lower covers.
Figure 3:
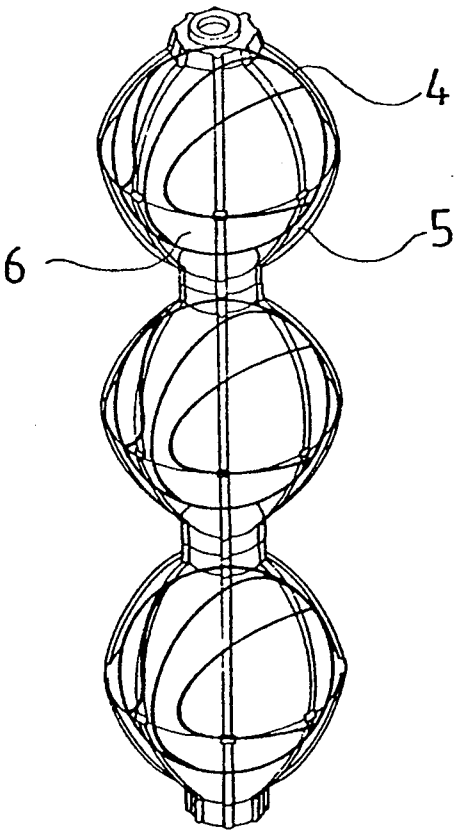
FIG. 3 illustrates the manner in which the ball holders as shown in FIG. 2 are stacked over one another.

The first and the second holding members 1, 2 are so designed that they have the curvature, diameter, and depth to contain a ball of any shape and size without letting the ball project out of the first end of the first and the second holding members 1, 2. This also permits multiple balls held by the ball holders of the present invention to stably stack over one another similar to the condition as shown in FIG. 3.

What is claimed is:

1. A ball holder, comprising a first holding member, a second holding member, a string, and a fastening plate; said first and said second holding members both consisting of a first end surface, a second end surface, and an inclined side wall; grooves being formed on said first end surfaces which face outward when said first and said second holding members are assembled with said string to clamp a ball between them; said grooves each having through holes formed at two ends thereof to each correspond to an elongated hole axially formed on said side walls of said first and said second holding members; a fastening means being provided on said side wall of said first holding member at a predetermined position for said string to pass through and wind about it; said fastening plate being located below said fastening means and being able to be pressed against said fastening means by pulling said string threaded through said fastening means and said fastening plate and thereby tightening them together; two fixing holes being additionally provided on said side wall of said second holding member at positions corresponding to said fastening means; said string being threaded through said through holes, elongated holes, and fixing holes via a predetermined route so as to detachably connect said first and said second holding members together to receive a ball between them; said fastening means being provided with dents to firmly clamp and locate said string passing therethrough so that a portion of said string between said fastening means and said additional fixing holes can serve as a carrying means; and a cradle-like inflator support being provided on said side wall of said first holding member opposite to said fastening means.

* * * * *